United States Patent [19]

Kaji et al.

[11] Patent Number: 4,517,948

[45] Date of Patent: May 21, 1985

[54] METHOD AND APPARATUS FOR CONTROLLING AIR-FUEL RATIO IN INTERNAL COMBUSTION ENGINES

[75] Inventors: Yasumasa Kaji; Shigenori Isomura, both of Kariya; Takashi Harada, Hekinan; Shuji Sakakibara, Kariya, all of Japan

[73] Assignee: Nippondenso Co., Ltd., Kariya, Japan

[21] Appl. No.: 515,788

[22] Filed: Jul. 21, 1983

[30] Foreign Application Priority Data

Aug. 3, 1982 [JP] Japan ..... 57-134684

[51] Int. Cl.[3] ..... F02M 17/00

[52] U.S. Cl. ..... 123/489

[58] Field of Search ..... 123/440, 486, 487, 480, 123/489

[56] References Cited

U.S. PATENT DOCUMENTS 4,130,095 12/1978 Bowler et al. ..... 123/440
4,235,204 11/1980 Rice ..... 123/489 X
4,319,451 3/1982 Tajima et al. .
4,321,903 3/1982 Kondo et al. .
4,345,561 8/1982 Kondo et al. .
4,348,727 9/1982 Kobayashi et al. .
4,348,728 9/1982 Sagisaka et al. .
4,365,299 12/1982 Kondo et al. .
4,441,473 4/1984 Isomura et al. ..... 123/489 X

*Primary Examiner*—Tony M. Argenbright
*Attorney, Agent, or Firm*—Cushman, Darby & Cushman

[57] ABSTRACT

An apparatus for controlling an air-fuel ratio in internal combustion engines has an RPM sensor, a combustion composition sensor, an intake air sensor and so on. Detection signals from these sensors are fetched by a microprocessor. A RAM is arranged in the microprocessor and is continuously supplied with power. The RAM has a first memory area which is divided into a plurality of areas for storing correction data corresponding to operating states of the engine. All the correction data stored in the first memory area are added together and the sum is divided by a given constant so as to obtain an updated correction amount. This updated correction amount is stored in a second memory area. The updated correction amount in the second memory area reflects the correction data stored in the first memory area. Given correction data stored in the first memory area is read out corresponding to a given intake air flow, thereby enabling feedback control.

12 Claims, 14 Drawing Figures

METHOD AND APPARATUS FOR CONTROLLING AIR-FUEL RATIO IN INTERNAL COMBUSTION ENGINES

BACKGROUND OF THE INVENTION

The present invention relates to a method and an apparatus for controlling an air-fuel ratio in internal combustion engines.

In a conventional electronic fuel injection control system, an oxygen concentration is detected to generate a feedback signal so as to control the fuel injection amount and hence the air-fuel ratio. The air-fuel ratio must be very precisely controlled by the feedback signal so that it falls within a narrow range having a stoichiometric air-fuel ratio as its center.

However, the basic air-fuel ratio often deviates from the stoichiometric air-fuel ratio in accordance with various factors. In this case, the control precision of the stoichiometric air-fuel ratio is decreased at the transient state, and the exhaust gas components are degraded. In order to eliminate this drawback, a learning control system is proposed to automatically correct the basic air-fuel ratio.

In this learning control system, the deviation of the basic air-fuel ratio with respect to the stoichiometric air-fuel ratio is detected as correction data or amount for every given rotational frequency by a control voltage level during the feedback control operation. The correction data is added to the basic data so as to correct the deviation of the basic air-fuel ratio.

When an automobile ascends or descends a high mountain, the correction data for feedback control greatly changes with respect to deviation in the air-fuel ratio. The correction data is stored in a memory. The correction data is then further updated as needed. However, when the automobile is running only along a sea level road, the corresponding correction data is obtained and is updated in the nonvolatile memory. In this case, correction data corresponding to any other operating state is not updated. As a result, proper correction data cannot be obtained for such other operating states. In this manner, when the operating conditions greatly change, the basic air-fuel ratio cannot follow the stoichiometric air-fuel ratio with high precision. As a result, effective air-fuel ratio control cannot be performed.

SUMMARY OF THE INVENTION

It is a principal object of the present invention to provide a method and an apparatus for precisely controlling the air-fuel ratio in internal combustion engines, wherein proper feedback correction data can be readily obtained for any given operating state so as to allow optimal control of the engine operation.

It is another object of the present invention to update a feedback correction amount within the entire operating range of the engine which includes the present operating range, thereby allowing constant control of the engine operation.

In the air-fuel ratio control system of the present invention, correction data is updated in accordance with the output signal from the combustion composition sensor. The updated correction data is then stored at an address corresponding to a given operating state of the engine. At the same time, the data is read out in accordance with the given operating state of the engine so as to perform feedback control. The storage data in the first memory is updated by data processing. This updated correction data is then stored in a second memory. The correction data stored in the second memory is added to or subtracted from the correction data of the first memory which corresponds to the given operating state of the engine, thereby updating feedback control data.

Therefore, even if the engine is operated in a given operating range, feedback control can be performed for another given operating range by reading out the correction data for the given operating range and by updating this correction data for another given operating range, thereby properly controlling the operation of the engine.

DETAILED DESCRIPTION OF THE PREFERRED EMBODIMENT

Figure 1:
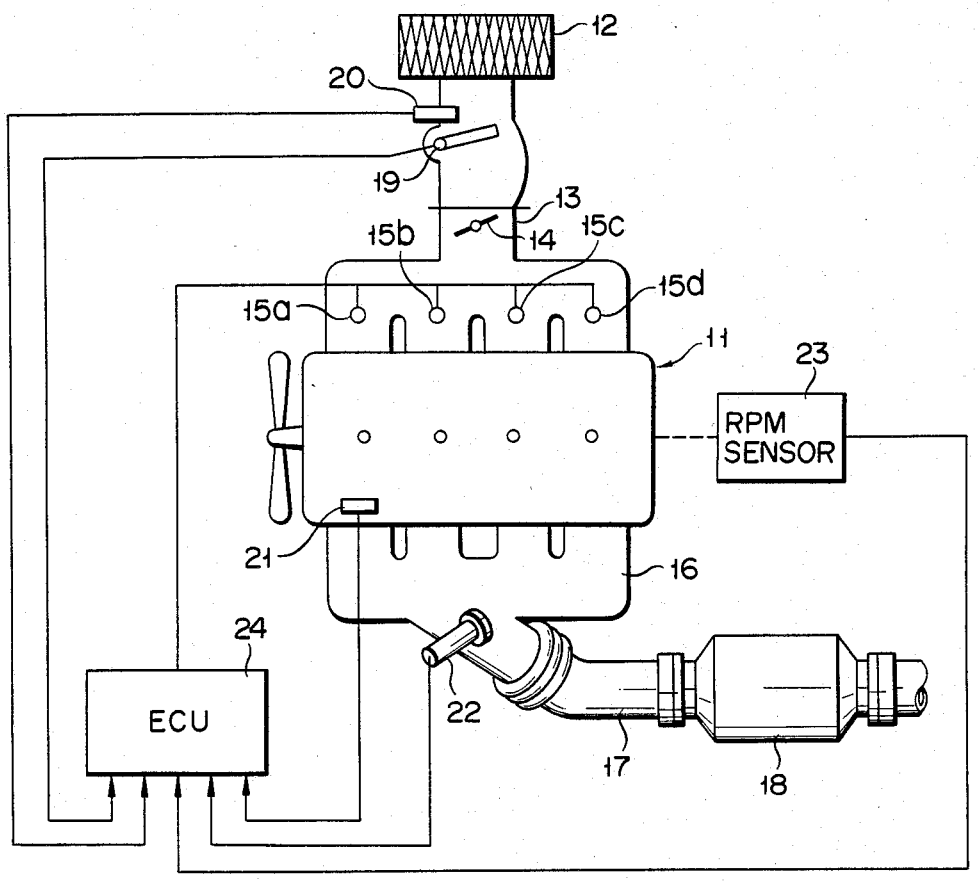
FIG. 1 is a representation explaining the engine system for performing air-fuel ratio control.

An engine 11 shown in FIG. 1 comprises a 4-cycle spark-ignition engine used as a power source installed in an automobile. Air is supplied through an air cleaner 12, an air intake pipe 13 and a throttle valve 14. Fuel is supplied from a fuel system (not shown) to electromagnetic fuel injectors 15*a*, 15*b*, 15*c* and 15*d* respectively corresponding to the cylinders of the engine 11. The exhaust gas in the combustion system is exhausted to the atmosphere through an exhaust manifold 16, an exhaust pipe 17 and a three-way catalytic converter 18.

An air-flow sensor 19 and an intake air temperature sensor 20 are arranged in the air intake pipe 13. The temperature sensor 20 comprises a thermistor for generating an analog voltage signal corresponding to the detected intake air temperature. A water temperature sensor 21 comprising a thermistor is arranged in the engine 11 so as to measure the temperature of cooling water. A combustion composition sensor 22 is arranged in the exhaust manifold 16 to detect the air-fuel ratio in accordance with the oxygen concentration in the exhaust gas. When the basic air-fuel ratio is smaller than the stoichiometric air-fuel ratio (rich state), the sensor 22 generates a high-level signal. Otherwise (lean state), the sensor 22 generates a low level signal.

The engine system is provided with an RPM sensor 23. The RPM sensor 23 generates a pulse signal (rotational frequency signal) having a cycle corresponding to the RPM of the engine 11. An ignition coil of the engine ignition unit is used as the RPM sensor 23. In this case, the ignition pulse signal from the primary winding terminal of the ignition coil is produced as an RPM signal.

The detection signals from the air-flow sensor 19, the intake air temperature sensor 20, the water temperature sensor 21, the combustion composition sensor 22 and the RPM sensor 23 are supplied to an electronic control unit (ECU) 24. The ECU 24 computes the fuel injection amount in accordance with the detection signals from the sensors 19 to 23 to control the on time of the injectors 15*a* to 15*d*, thereby adjusting the air-fuel ratio for the engine 11.

Figure 2:
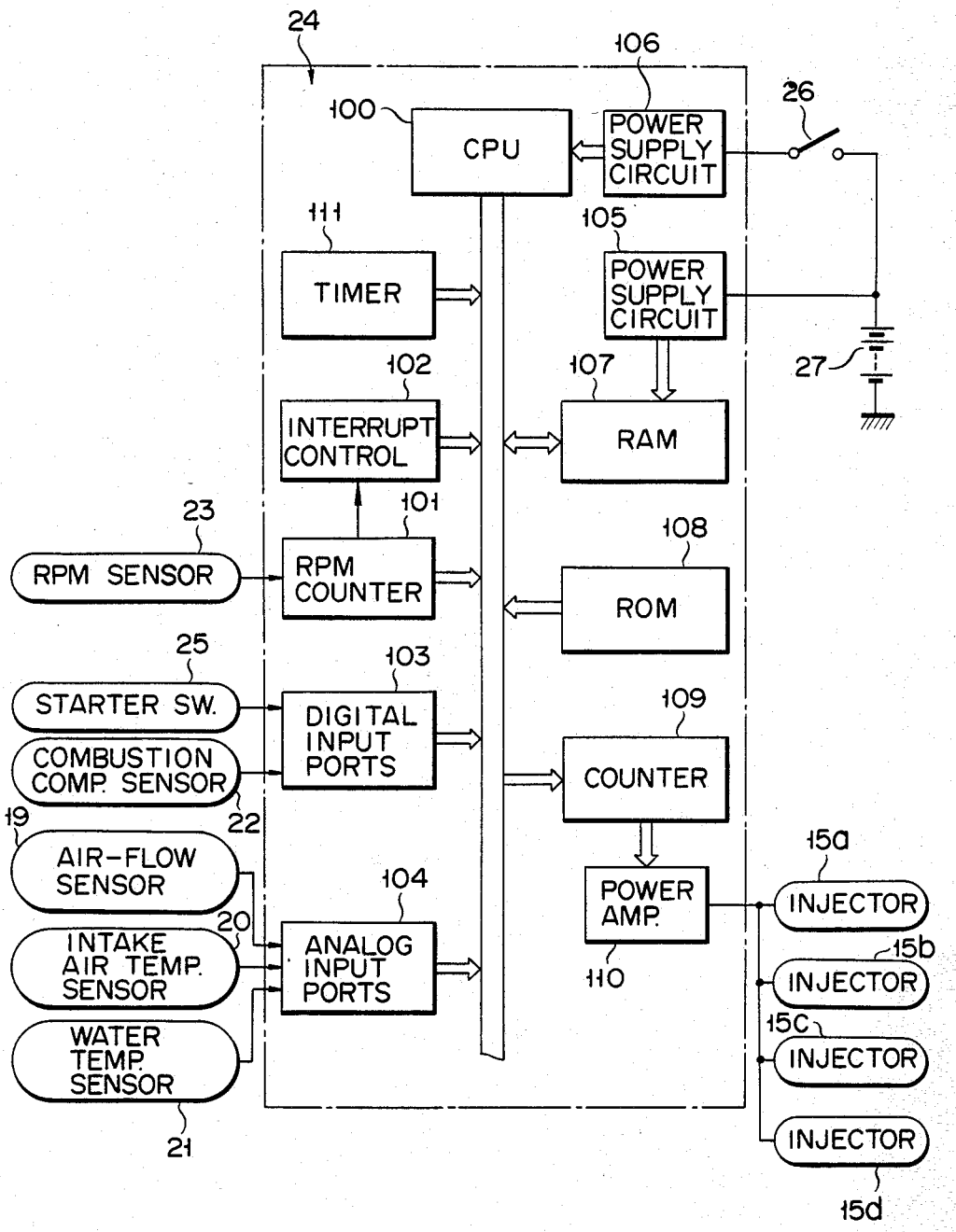
FIG. 2 is a block diagram of an air-fuel ratio control apparatus according to an embodiment of the present invention.

FIG. 2 shows the overall arrangement of the ECU 24. The ECU 24 has a microprocessor 100 for computing the fuel injection amount. The detection signal from the RPM sensor 23 is supplied to an RPM counter 101 which measures the ignition pulses. The RPM counter 101 supplies an interrupt designation signal to an interrupt control 102 in synchronism with rotation of the engine 11. When the interrupt control 102 receives the interrupt command signal, an interrupt signal is supplied from the interrupt control 102 to the microprocessor 100 through a common bus 150. The detection signal from the combustion composition sensor 22 and digital signals such as a starter signal from a starter switch 25 for controlling the ON/OFF operation of the starter are supplied to digital input ports 103. The signals received at the digital input ports 103 are transmitted to the microprocessor 100 through the common bus 150. Analog input ports 104 comprise an analog multiplexer and an A/D converter. The detection analog signals from the air-flow sensor 19, the intake air temperature sensor 20 and the water temperature sensor 21 are supplied to the analog input ports 104. The detection signals from the sensors 19, 20 and 21 are sequentially supplied to the multiplexer and are converted by the A/D converter into digital signals. These digital signals are obtained from the microprocessor 100 through the common bus 150.

Two power supply circuits 105 and 106 are arranged in the control circuit 24. The power supply circuit 105 supplies power to a RAM 107, and the power supply circuit 106 supplies power to any element other than the RAM 107. A battery 27 is connected to the power supply circuit 106 through a key switch 26. The power supply circuit 105 is directly connected to the battery 27 and supplies power to the RAM 107 irrespective of the operation of the key switch 26. The battery back-up RAM 107 constitutes a temporary storage unit during the execution of the program. The RAM 107 comprises an IC nonvolatile or IC static memory whose data is not lost even after the key switch 26 is turned off to stop operation. The RAM 107 is connected to the microprocessor 100 through the common bus 150. A ROM 108 is also connected to the common bus 150. The ROM 108 stores the program and various types of constants.

The fuel injection amount data computed by the microprocessor 100 is transmitted through the common bus 150 to a fuel injection time control counter 109 which includes registers. The counter 109 comprises a down counter which converts the digital signal indicating the fuel injection amount computed by the microprocessor 100 into a pulsed signal. The pulsed signal has a pulse width corresponding to the ON time of the injectors 15*a* to 15*d*. The pulsed signal is then supplied to a power amplifier 110. An output signal from the power amplifier 110 is used to control the injectors 15*a* to 15*d*. A timer 111 measures a time interval, and this time data is then fetched by the microprocessor 100.

The RPM counter 101 measures the period of the output signals from the RPM sensor 23 and measures the engine speed. When the measurement is completed, an interrupt command signal is supplied to the interrupt control 102. The interrupt control 102 then causes the microprocessor 100 to execute the interrupt processing routine, thereby computing the fuel injection amount.

Figure 3:
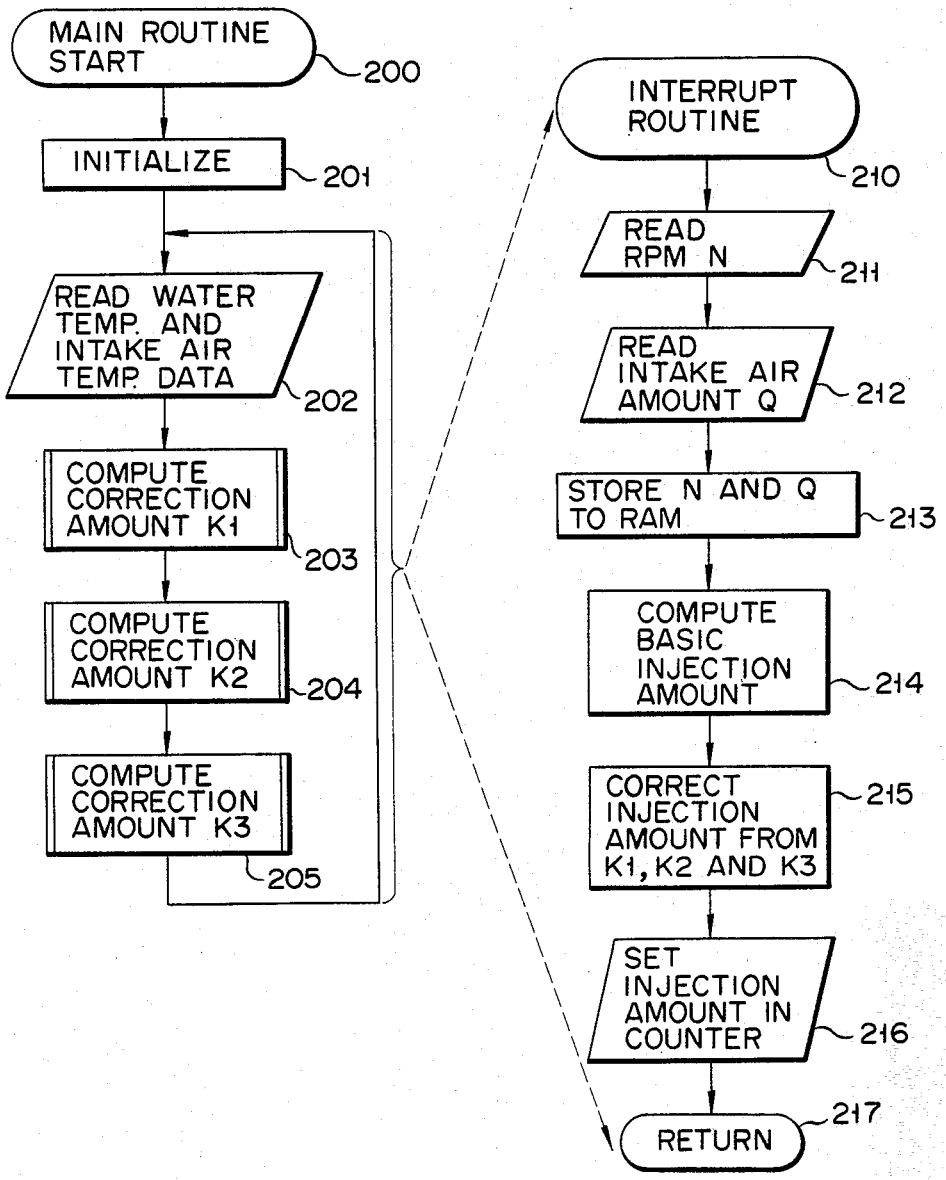
FIG. 3 is a flow chart for explaining the operation of a microprocessor of the apparatus shown in FIG. 2.

FIG. 3 is a flow chart for explaining the fuel injection amount computed by the microprocessor 100. When the key switch 26 and the starter switch 25 are turned on, the engine is started, and the main routine is executed.

In step 201, the initialization procedure is performed. In step 202, digital data of the cooling water temperature and intake air temperature are read from the analog input ports 104. In step 203, a first correction amount K1 is computed in accordance with the cooling water temperature data and the intake air temperature data. A computed result is stored in the RAM 107. The first correction amount K1 is fetched from the RAM 107 so as to correspond to the preset water temperature data and the preset intake air temperature data which are stored in the ROM 108 at the time of the interrupt operation. In step 204, the detected data from the combustion composition sensor 22 is read from the digital input ports 103 to the microprocessor 100 so as to decrease/increase a second correction amount K2 (to be described later) as a function of the time interval counted by the timer 111, thereby storing the second correction amount K2 as integrated data in the RAM 107.

Figure 4:
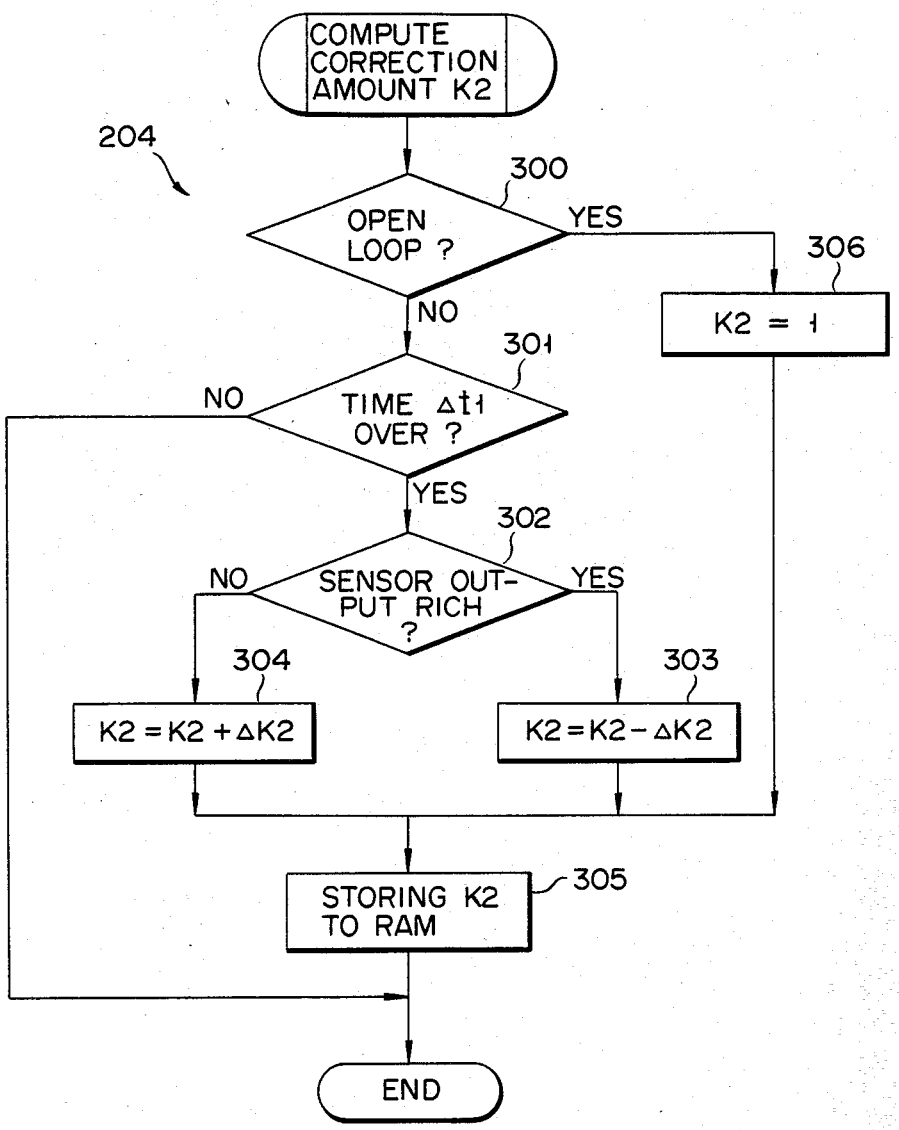
FIG. 4 is a flow chart for explaining the operation of a means for obtaining a correction amount K2 in the flow chart shown in FIG. 3.

FIG. 4 is a flow chart for explaining step 204 for computing the second correction amount K2 as integrated data. It is determined in step 300 whether or not the combustion composition sensor is energized, and whether or not air-fuel ratio feedback control is performed from the cooling water temperature data. If it is determined that the feedback control cannot be performed (i.e., if an open loop is formed), the routine advances to step 306. In step 306, the second correction amount K2 is set to 1, and the flow advances to step 305.

If the result is NO in step 300 (i.e., if feedback control can be performed), the routine advances to step 301. It is then determined in step 301 whether or not a predetermined unit time interval $\Delta t1$ has elapsed. If NO in step 301, the correction amount K2 is not updated and step 204 is ended. However, if YES in step 301, the flow advances to step 302. In step 302 it is determined whether or not the air-fuel ratio is rich. If the combustion composition sensor 22 produces a high level signal which indicates a rich mixture, the flow advances to step 303. The correction amount K2 obtained in the preceding cycle is decreased by $\Delta K2$ in step 303. However, if it is determined in step 302 that the mixture (i.e., air-fuel ratio) is lean and if the combustion composition sensor 22 produces a signal of low level, the correction amount K2 is increased by $\Delta K2$ in step 304. The updated correction amount K2 updated in step 303 or 304 is stored in the RAM 107 in step 305. In this manner, the correction amount K2 is updated in accordance with the air-fuel ratio.

After step 204 is executed (that is, after the correction amount K2 is computed), the flow advances to step 205.

In step 205, a third correction amount K3 is increased or decreased. An updated result is then stored in the RAM 107.

Figure 5:
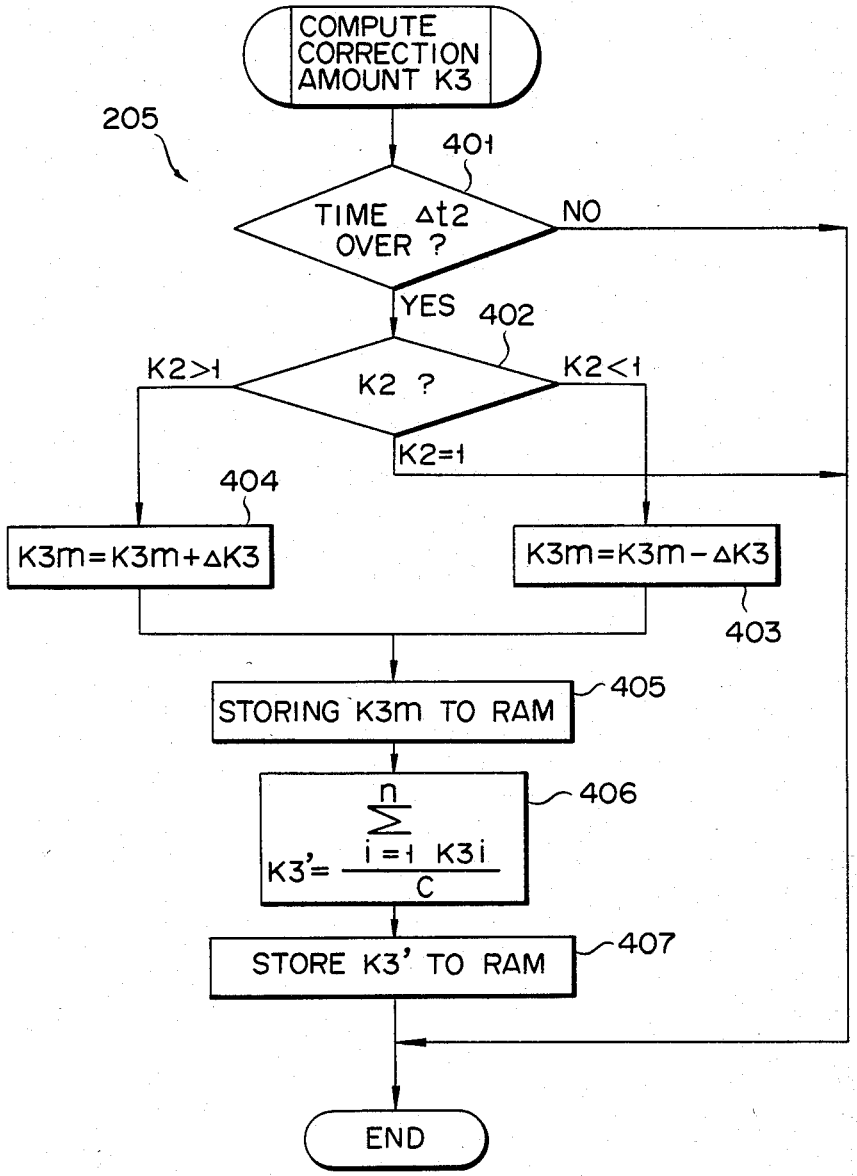
FIG. 5 is a flow chart for explaining the operation of a means for obtaining a correction amount K3 in the flow chart shown in FIG. 3.

FIG. 5 is a detailed flow chart of step 205 wherein the third correction amount K3 is computed and updated. It is determined in step 401 whether or not a predetermined unit time interval $\Delta t2$ has elapsed. If NO in step 401, this storage processing step 205 is ended. However, if YES in step 401, the flow advances to step 402. It is then determined in step 402 whether or not the updated correction amount K2 is equal to, smaller than or larger than 1. If it is determined in step 402 that the correction amount K2 is equal to 1, no processing is performed and the storage processing step 205 is ended.

The third correction amount K3 is set in response to the value of the intake air flows Q. Namely, the intake air flows, from the minimum air quantity state when idling to the maximum air quantity state when the throttle is wide open, are divided into n ranges, and third correction amounts K3(1) to K3(n) are set respectively for these corresponding n divided ranges. Accordingly, the region which stores the third correction amount K3 of RAM 107 is n divided corresponding to the intake air flows Q. The third correction amounts K3(1) to K3(n) are stored in each of these divided regions. Then, the third correction amount which corresponds to the mth divided region is designated by K3(m).

In step 402, if it is determined in step 402 that the second correction amount K2 is smaller than 1, the flow advances to step 403. In step 403, the correction amount K3(m) corresponding to the present intake air flow is decreased by $\Delta K3$. However, if it is determined in step 402 that the second correction amount K2 is greater than 1, the flow advances to step 404. In step 404, the correction amount K3(m) is increased by $\Delta K3$. In step 405, the updated result in step 403 or 404 is stored at an address of the RAM 107 which corresponds to the present intake air flow Q.

In step 406, the correction amounts K3(1) to K3(n) which are stored in n memory areas of the RAM 107 are added together. The sum is divided by a given constant C so as to obtain an updated correction amount K3'. The correction amount K3' is stored in the RAM 107 in step 407.

Figure 6:
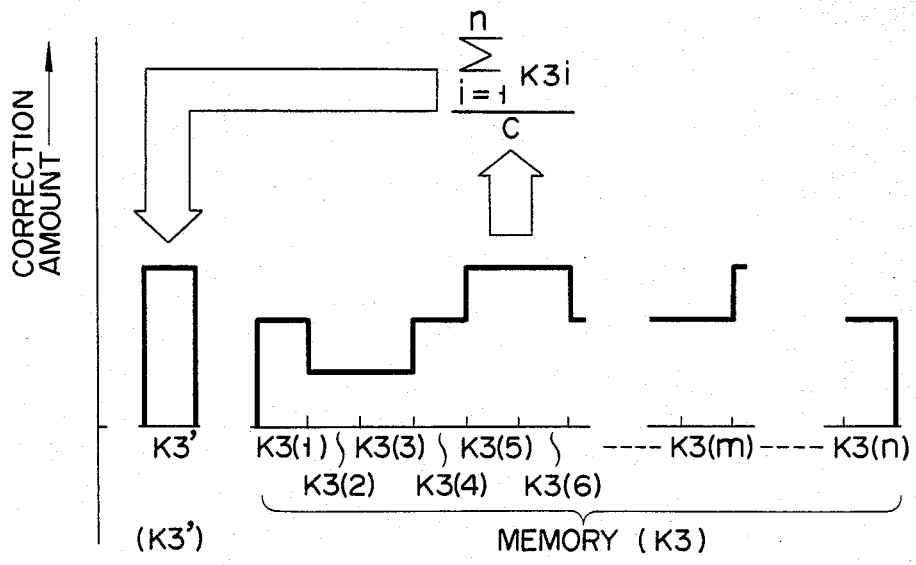
FIG. 6 is a representation explaining the storage condition of data in a RAM of the apparatus shown in FIG. 2.

FIG. 6 shows the processing status in step 406. The correction amounts K3(1) to K3(n) are respectively stored as the third correction amounts K3 in n memory areas divided in accordance with n operating states of the engine. A total sum of the correction amounts K3(1) to K3(n) is then obtained and the sum is divided by the given constant C. The divided result K3' is stored in a second memory area. The correction amounts K3 and K3' which are respectively stored in the first and second memory areas of the RAM 107 are updated.

Figure 7A:
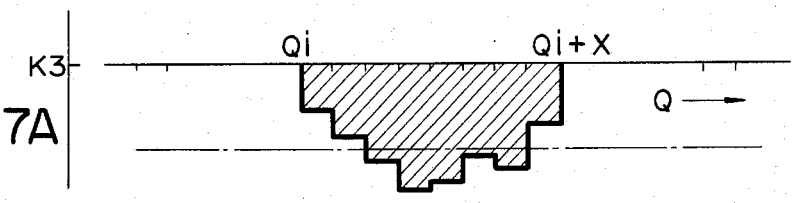
FIGS. 7A to 7C are representations explaining the air-fuel control conditions for different operating states, respectively.
Figure 7B:
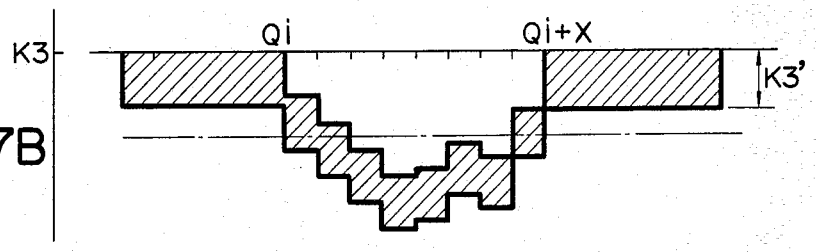
Figure 7C:
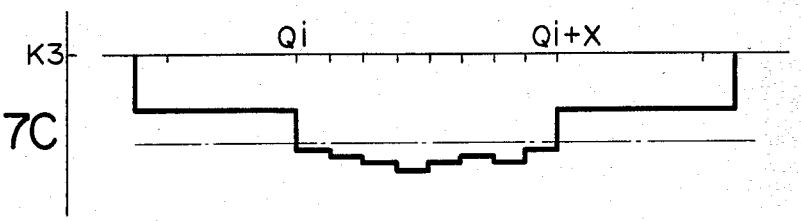

FIGS. 7A to 7C are representations explaining the operations on the third correction amount K3 in step 205. Here assume that the automobile ascends a hill to an altitude of about HO (above sea level). In this condition, the intake air flow Q for the engine varies in a range from $Q_i$ to $Q_{i+x}$, as shown in FIG. 7A.

As the altitude of the automobile increases, the air density changes, and so, the ideal air-fuel ratio also changes. The correction amount K3 must be updated as indicated by an alternate long and short dashed line in FIG. 7A. However, in practice, the correction amount K3 is updated only within a range between $Q_i$ and $Q_{i+x}$ used for the operation of the engine. In order to eliminate this drawback, the processing shown in step 406 and thereafter (FIG. 5) is executed. Each of the correction amounts K3(m) is decreased by the updated correction amount K3' as shown in FIG. 7B. Furthermore, in steps 401 to 405, all those correction amounts K3(m) which fall between $Q_i$ and $Q_{i+x}$ are updated. As a result, the correction amount K3 is properly updated within the entire range of changes in the intake air flow Q, as shown in FIG. 7C.

Since the updating of the correction amount K3 {(=K3(m)} can be monitored corresponding to the intake air flow of the basic operation of the engine, the correction amount K3 for any other intake air flow can be properly updated.

In practice, steps 202 to 205 of the main routine shown in FIG. 3 are repeated in accordance with the control program.

When the interrupt signal for the fuel injection amount computation is supplied from the interrupt control 102 to the microprocessor 100, the main routine is immediately interrupted, and interrupt step 210 is started. In step 211, a signal indicating the rotational frequency (RPM) N of the engine is fetched from the RPM counter 101 to the microprocessor 100. In step 212, a signal indicating the intake air flow Q is fetched from the analog input ports 104 to the microprocessor 100. The air flow Q is stored in the RAM 107 in step 213 in order to use the air flow Q as a parameter for updating the third correction amount K3. In step 214, an injection time interval t is computed in accordance with the rotational frequency N and the intake air flow Q as follows:

$$t = F \times Q/N$$

where F is a constant. In step 215, the correction amounts K1, K2 and K3 which are used for fuel injection and are obtained by the main routine are read out from the RAM 107. The correction computation of a fuel injection time interval (fuel injection amount) T for providing a proper air-fuel ratio is then performed. The fuel injection time interval T is given as follows:

$$T = t \times K1 \times K2 \times K3$$

The time interval data corresponding to the fuel injection amount computed in step 216 is set in the counter 109. The flow advances to step 217, thus returning to the main routine. In this case, the step at which the interrupt operation was initiated is executed.

One possible air-fuel ratio controlling method would be as follows. When feedback control is performed in accordance with the output signal from the combustion composition sensor, the present correction amount is stored in a read/write memory in accordance with the given operating state of the engine. Furthermore, the air-fuel ratio is also controlled in accordance with the given operating state of the engine. When it is determined that the correction data has been increased/decreased beyond a predetermined amount in a given state of engine operation, the correction data is updated by a specific value within the entire range of the different operating states.

Figure 8A:
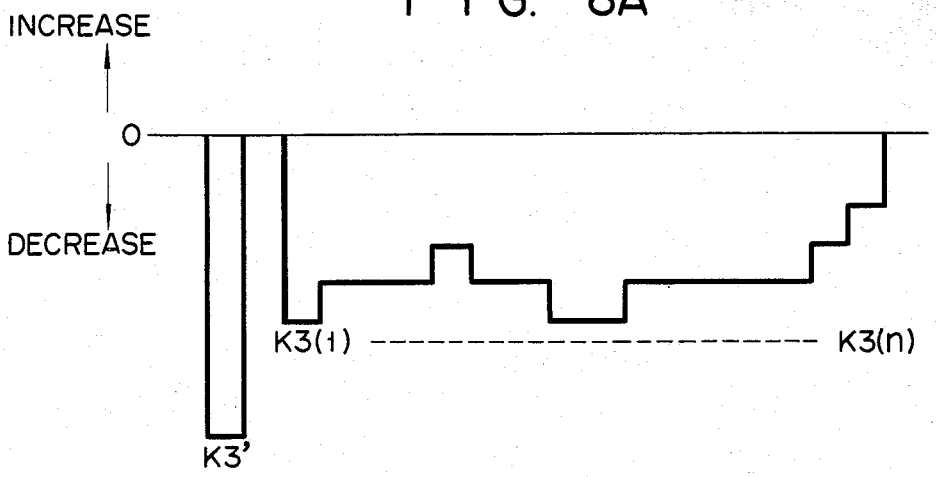
FIGS. 8A to 8C are representations explaining the air-fuel control conditions when the system of the present invention is not applied.
Figure 8B:
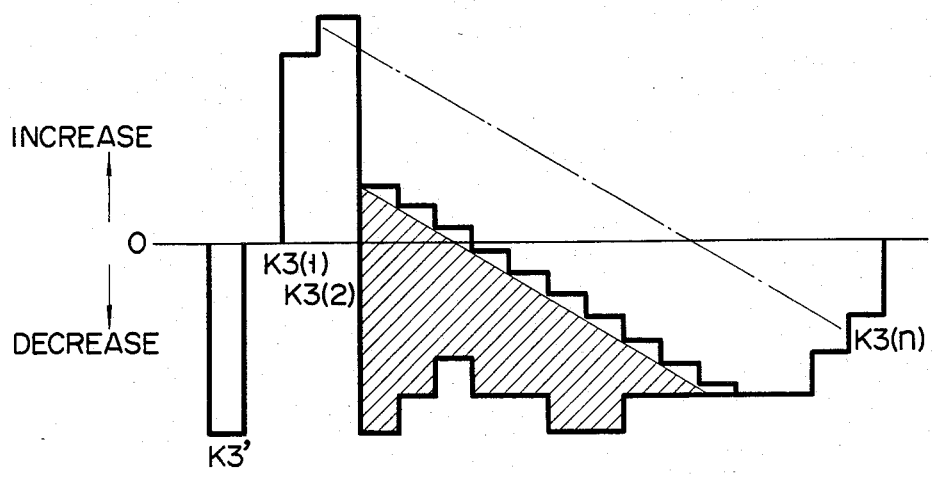
Figure 8C:
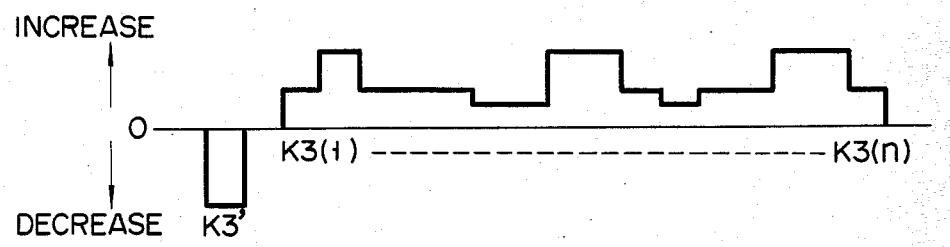

However, when the above method is utilized, a drawback shown in FIGS. 8A to 8C occurs when the correction amount corresponding to the operating state of the engine is controlled so as not to exceed a limit value.

For example, when the mixture becomes rich due to a low pressure and volatile fuel while the automobile is ascending a hill, the correction amounts K3 and K3′ are decreased, as shown in FIG. 8A. Thereafter, when the automobile descends to a lower altitude, the influence of the low pressure and volatile fuel is eliminated, so that the correction amounts K3(1) and K3(2) corresponding to the low intake air flow (i.e., a descent) are updated as shown in FIG. 8B. In this condition, the correction amounts K3(1) and K3(2) are increased by K3′, respectively. The increment/decrement becomes substantially zero.

When the correction amount exceeds a given limit, only the limit value is corrected. For this reason, values which exceed the given limit and are included in the hatched area are simply eliminated without considering the correction value K3′. Therefore, when the automobile runs using a full range between the lowest intake air flow and the highest intake air flow, the correction amount K3 is updated in accordance with the continuously changing intake air flow. In this case, the correction amounts K3(1) to K3(m) are as shown in FIG. 8C. However, since the condition shown in FIG. 8B is present, the correction amount K3′ is decreased and becomes unbalanced with respect to the correction amounts K3(1) to K3(n). In other words, it is very difficult to compute the amount indicated by the hatched area (FIG. 8B) so as to reflect it in the correction amount K3′. Therefore, the correction amount K3′ must be computed every time one of the correction amounts K3(1) to K3(m) is updated, resulting in cumbersome, time-consuming operation.

However, according to the present invention, the correction amounts K3 stored in the RAM 107 are added together, and the obtained sum is divided by a given constant, thereby obtaining a correction amount f(K3), as described with reference to FIGS. 5 and 6.

Figure 9A:
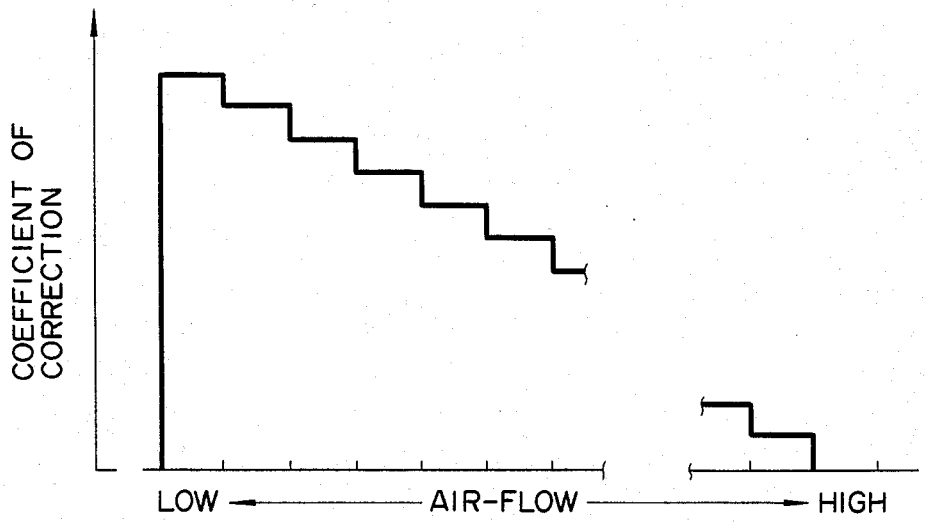
FIGS. 9A and 9B are representations explaining the coefficient of correction as a function of the air flow.
Figure 9B:
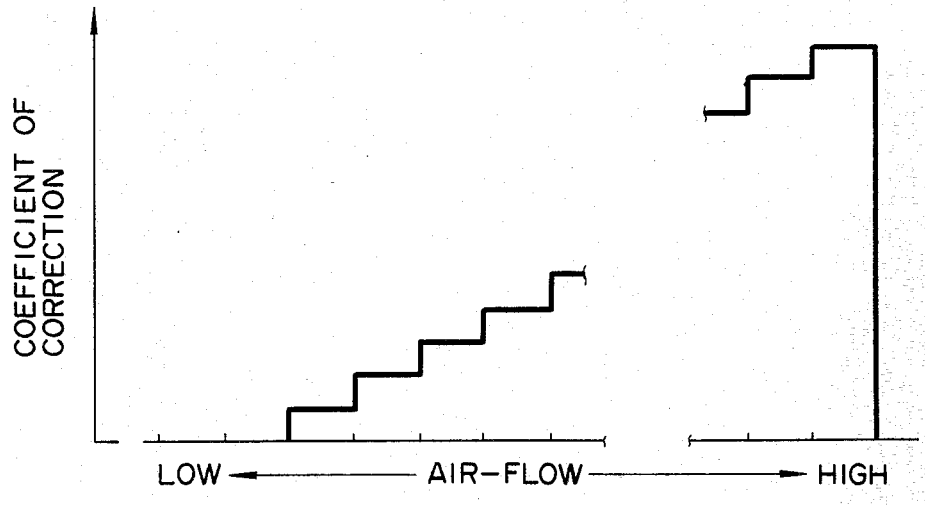

Furthermore, weighted coefficients respectively corresponding to different operating states may be set. In this case, the weighted coefficient corresponding to the given operating state is added to the correction amount K3(i) so as to update the correction amount K3(i). The updated correction amount K3(i) is entirely reflected in the correction amounts K3(1) to K3(n). A weighted coefficient which favors a low intake air flow may be used for the correction coefficients, as shown in FIG. 9A. Alternatively, as shown in FIG. 9B, a weighted coefficient which favors a high intake air flow may be used for the correction coefficients. In either case, f(K3) is computed using the correction amount K3 weighted with the selected weighted coefficient.

In the air-fuel ratio control system according to the present invention, the correction data for feedback control is updated using the output signal from the combustion composition sensor. Updated correction data K3 is stored in the memory so as to correspond to the respective operating state. The air-fuel ratio is then controlled in accordance with the updated correction data for a given operating state. In this case, the correction amount K3′ is computed on the basis of the correction amounts K3(1) to K3(n) respectively corresponding to the different operating states and is stored in the memory. The correction amount K3′ is added to or subtracted from each of the correction amounts K3(1) to K3(n). Therefore, even if the engine is operated in an operating state which is different from the present operating state, the correction amount for feedback control of the present operating state is updated for the new operating state. In other words, the learning control of the air-fuel ratio in the internal combustion engine is properly performed.

What we claim is:

1. A method for controlling an air-fuel ratio in an internal combustion engine, comprising the steps of:

setting correction data for feedback control so as to respectively correspond to operating states of the engine;

updating, upon detecting a given operating state, given correction data corresponding to the given operating state in accordance with an output signal from a combustion composition sensor;

computing an updated correction amount on the basis of all the correction data including the updated given correction data;

reflecting the updated correction amount in all the correction data so as to set correction data corresponding to a new operating state of the engine; and reading the correction data respectively corresponding to the operating states of the engine in accordance with the new operating state so as to perform feedback control.

2. A method according to claim 1, wherein the updated correction amount is computed by dividing a sum of a plurality of correction data respectively corresponding to the operating states of the engine by a given constant.

3. A method according to claim 1, wherein the step of updating the given correction data comprises a step of increasing or decreasing the given correction data by a specific correction value corresponding thereto in accordance with a rich or lean output signal from said combustion composition sensor for detecting an oxygen content in an exhaust gas.

4. A method according to claim 1, wherein the operating states of the engine are determined in accordance with an intake air flow.

5. An apparatus for controlling an air-fuel ratio in an internal combustion engine, comprising:

a combustion composition sensor for generating an output signal corresponding to an oxygen content in an exhaust gas of the engine;

first memory means for storing correction data in respective memory areas thereof corresponding to operating states of the engine;

correction data updating means for detecting a given operating state of the engine, for updating given correction data which is stored in said first memory means and which corresponds to the given operating state in accordance with an output signal from the combustion composition sensor, and for storing updated correction data in said first memory means;

correction amount computing means for updating all correction data stored in said first memory means including the updated correction data and for computing an updated correction amount;

second memory means for storing the updated correction amount;

reflecting means for reflecting the updated correction amount in all the correction data stored in said first memory means; and feedback controlling means for reading out the given updated correction data from said first memory means in accordance with the given operating state so as to perform feedback control.

6. An apparatus according to claim 5, wherein said first and second memory means comprise nonvolatile memories, respectively.

7. An apparatus according to claim 5, wherein said first and second memory means comprise a RAM, said RAM being always supplied with battery power.

8. An apparatus according to claim 5, wherein the updated correction amount stored in said second memory means is computed by dividing a sum of the plurality of correction data respectively stored in memory areas of said first memory means by a given constant.

9. An apparatus according to claim 5, wherein said correction data updating means comprises determining means for determining a rich or lean state from the output signal from said combustion composition sensor for detecting the oxygen content in the exhaust gas, and means for increasing or decreasing the given correction data corresponding to the given operating state in accordance with a given correction value corresponding thereto and with a determination result of said determining means.

10. An apparatus according to claim 9, wherein the updating of the correction data is completed when said combustion composition sensor is rendered conductive and when the determination result is obtained therefrom.

11. An apparatus according to claim 5, wherein the plurality of correction data respectively stored in the memory areas of said first memory means are updated by the updated correction amount stored in said second memory means, and the updated correction data respectively stored in the memory areas of the first memory means are updated again in accordance with the output signal from said combustion composition sensor, thereby reflecting the correction data in the updated correction amount stored in said second memory means.

12. An apparatus for controlling an air-fuel ratio in an internal combustion engine, comprising:

means for detecting the operating state of the engine;

a combustion composition sensor for detecting the state of the air-fuel ratio from an oxygen content in an exhaust gas of the engine; and an electronic control unit connected to receive detection signals from said detecting means and said combustion composition sensor, and including a microprocessor, a read only memory for storing a program, and a random access memory comprising first and second memory sections, said first memory section being comprised of a plurality of memory areas corresponding to the operating states of the engine and storing correction data therein corresponding to the operating states of the engine and said second memory section storing a correction amount updated on the basis of the correction data which is stored in the memory area of said first memory section, said microprocessor being adapted to update the correction data, on the basis of an output of said combustion composition sensor, which is stored in the first memory section of said random access memory and to store the updated correction data again in the corresponding memory area of said first memory section, said microprocessor further being adapted to calculate the correction data stored in the first memory section to obtain updated correction amounts, and to store said updated correction amounts in the second memory section, further being adapted to permit said updated correction amounts stored in said second memory section to be reflected in all the correction data stored in said first memory area, and further adapted to designate according to the operating state of the engine the corresponding memory area of said first memory section, to read the correction data out of the designated memory area of the first memory section and to reflect it in an air-fuel ratio feedback control amount.

* * * * *